US006077168A

United States Patent [19]

Huang

[11] Patent Number: 6,077,168

[45] Date of Patent: Jun. 20, 2000

[54] SWING-PRACTICING DEVICE FOR GOLF

[76] Inventor: Huei Yueh Huang, No. 21, Alley 9, Lane 27, Sec. 5, Min Sheng E. Rd., Taipei, Taiwan

[21] Appl. No.: 09/296,869

[22] Filed: Apr. 21, 1999

[51] Int. Cl.[7] ..... A63B 69/36

[52] U.S. Cl. ..... 473/218; 473/270; 473/273

[58] Field of Search ..... 473/218, 266, 473/269, 270, 273, 409

[56] References Cited

U.S. PATENT DOCUMENTS 4,257,608 3/1981 Funk ..... 473/266

4,384,718 5/1983 Cachola ..... 473/266

5,362,060 11/1994 Hinson ..... 473/266

*Primary Examiner*—Kien T. Nguyen

*Attorney, Agent, or Firm*—Rosenberg, Klein & Lee

[57] ABSTRACT

A swing-practicing device for golf, comprises a first shaft, a second shaft, a third shaft, a fourth shaft, a fifth shaft and a ball mount. Those shafts and ball mount are pivotally connected by bolt and clamping holes thereon. Whereby user can find a precise standing point and the golf ball can be positioned at a precise position.

2 Claims, 9 Drawing Sheets

SWING-PRACTICING DEVICE FOR GOLF

FIELD OF THE INVENTION

The present invention relates to a swing-practicing device for golf, more particularly, to a swing-practicing device for golf, by which user can find a precise standing point and the golf ball can be positioned at a precise position.

BACKGROUND OF THE INVENTION

FIG. 1 shows a conventional swing-practicing device for golf which comprises a first shaft 10*a,* a second shaft 11*a* and a third shaft 12*a*. The second shaft 11*a* is pivotally arranged on one end of the first shaft 10*a* by a screw 13*a* such that the practicing device is foldable for saving space. The first shaft 10*a* and the second shaft 11*a* is vertically intersected and the third shaft 12*a* is slidably connected to the first shaft 10*a* through a slot 14*a,* therefore, the practicing device can be adjusted for different users. The first shaft 10*a* and the third shaft 12*a* are also vertically intersected such that the practicing device can divide the ground, over which the practicing device is placed, into multiple regions. The use can locate the swing position thereof and the position of the golf ball 15*a* by those shafts 10*a,* 11*a* and 12*a*. However, even thought with the above-mentioned practicing device, the user finds it hard to locate the point for standing and to locate the golf ball to a specific point.

The various objects and advantages of the present invention will be more readily understood from the following detailed description when read in conjunction with the appended drawing, in which:

DETAIL DESCRIPTION OF PREFERRED EMBODIMENT

Figure 1:
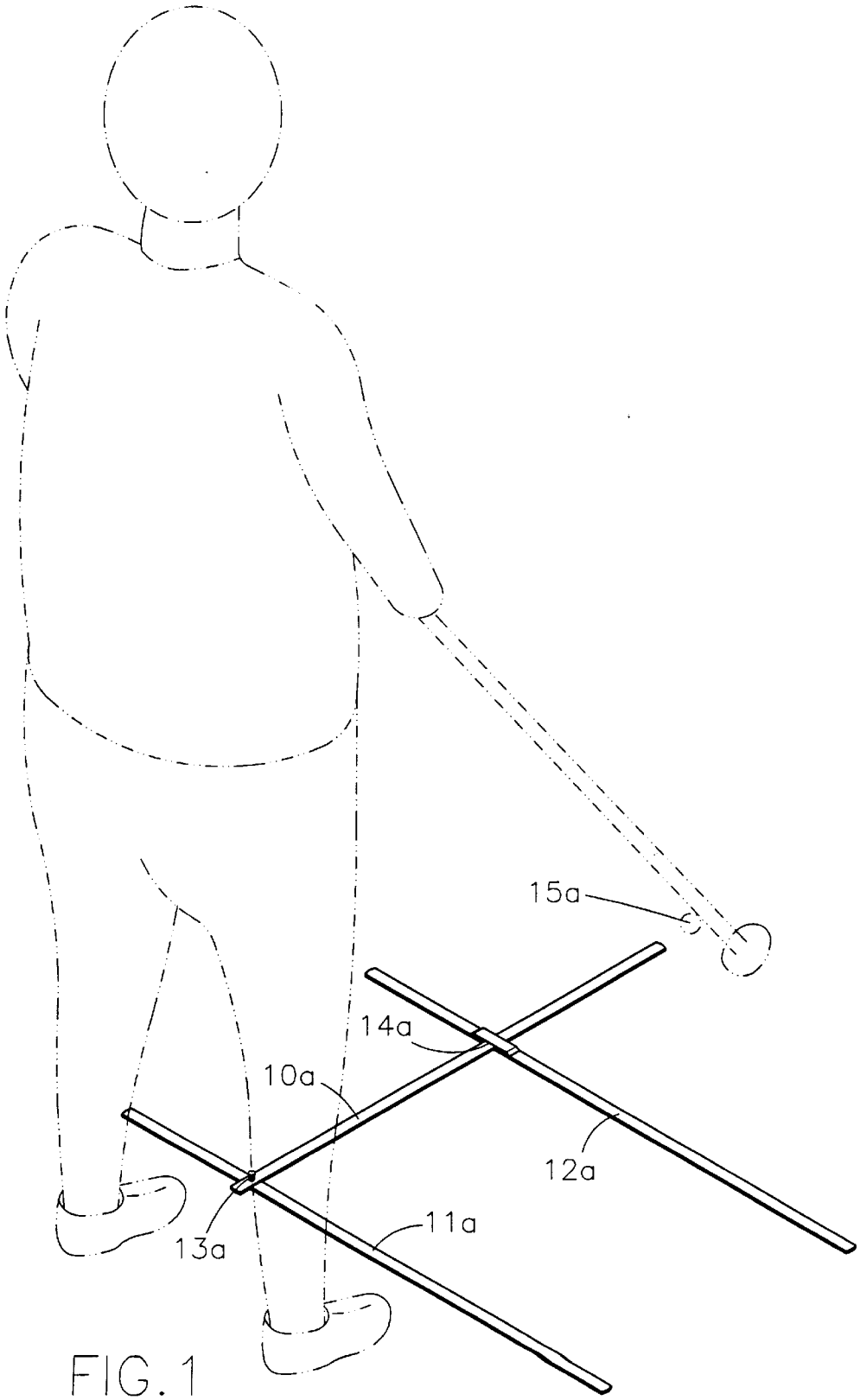
FIG. 1 PRIOR ART
FIG. 1 is a perspective view of a conventional golf practicing device.
Figure 2:
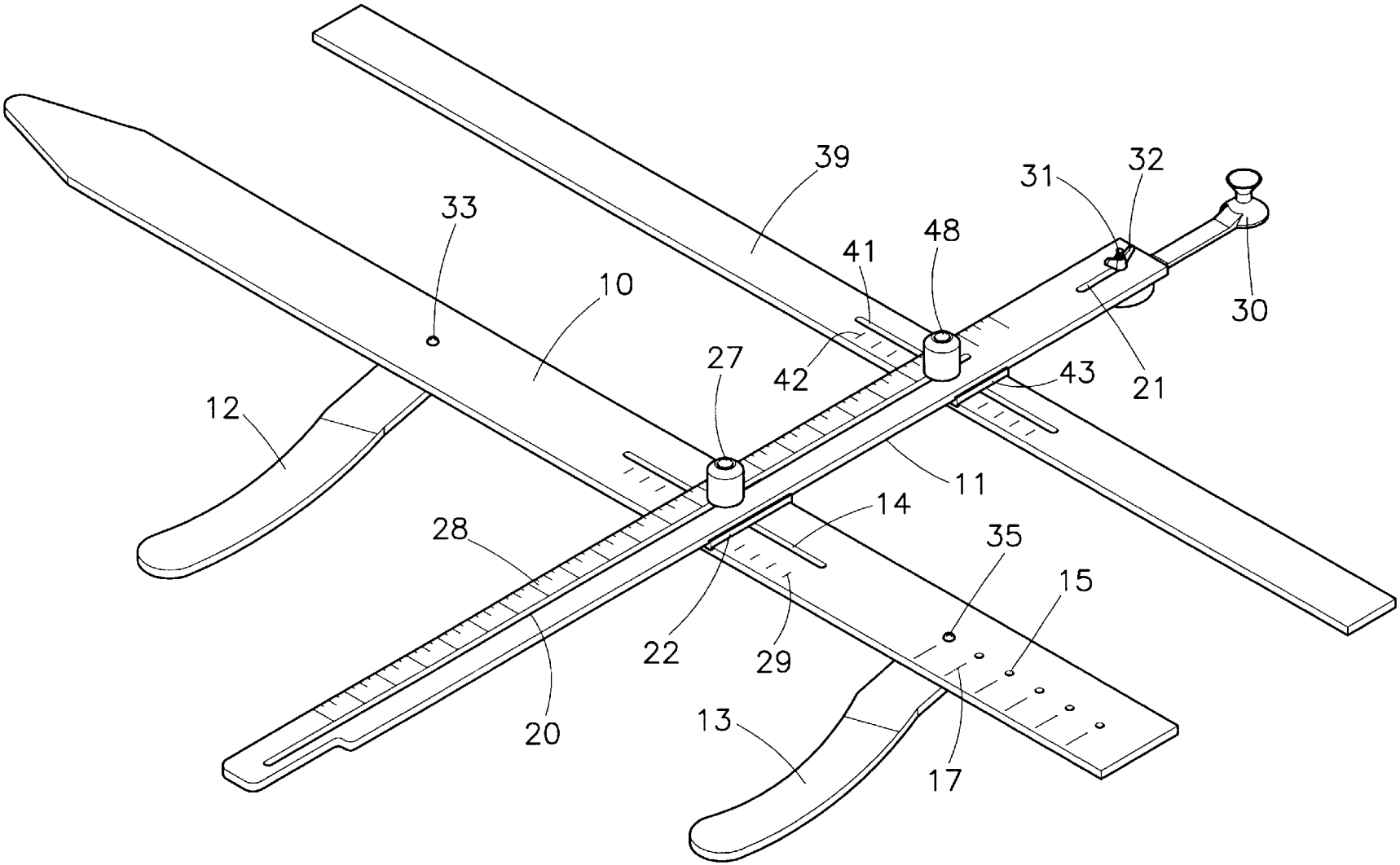
FIG. 2 is the perspective view of the present invention.
Figure 3:
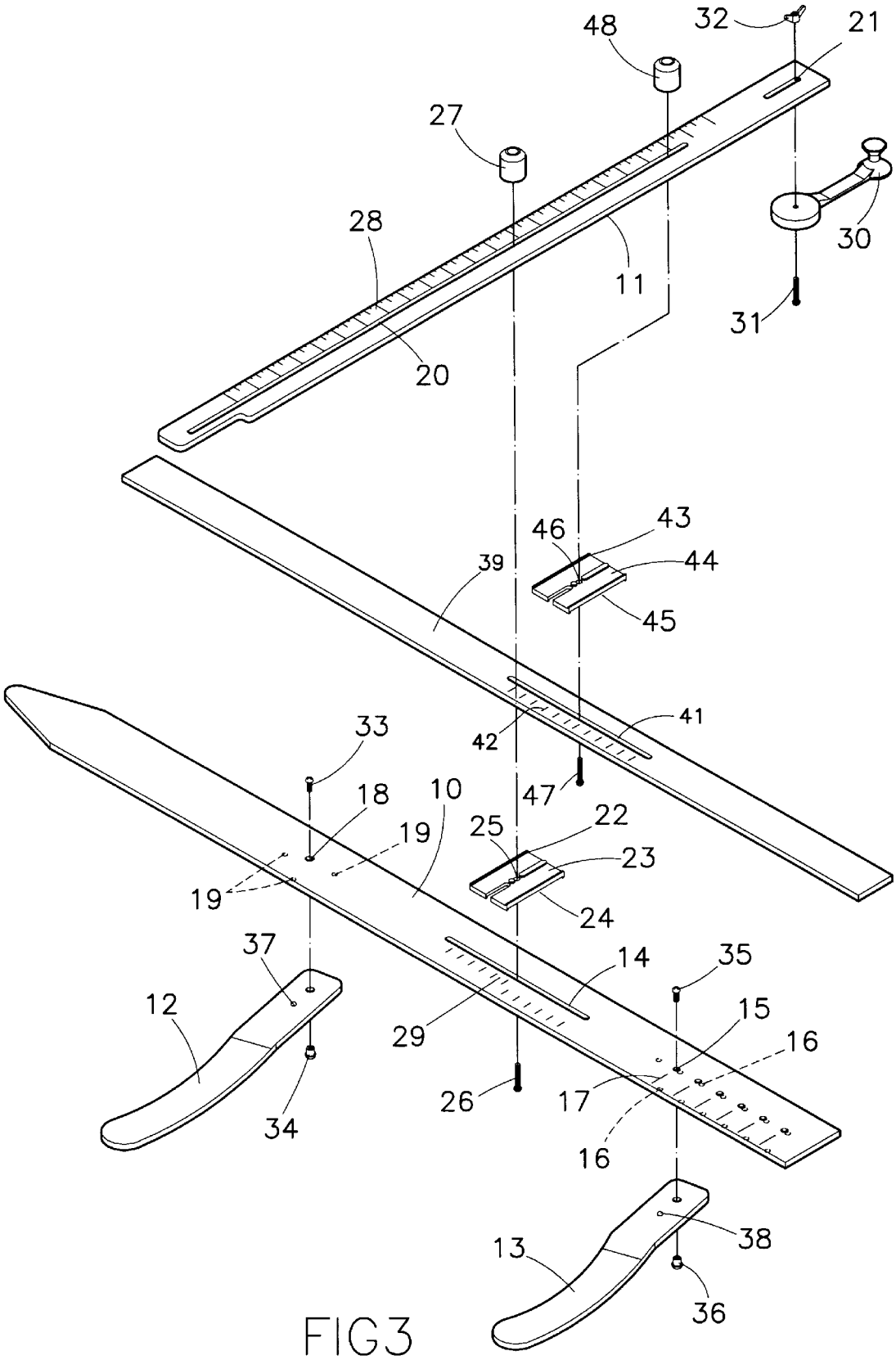
FIG. 3 is the exploded view of the present invention.
Figure 4:
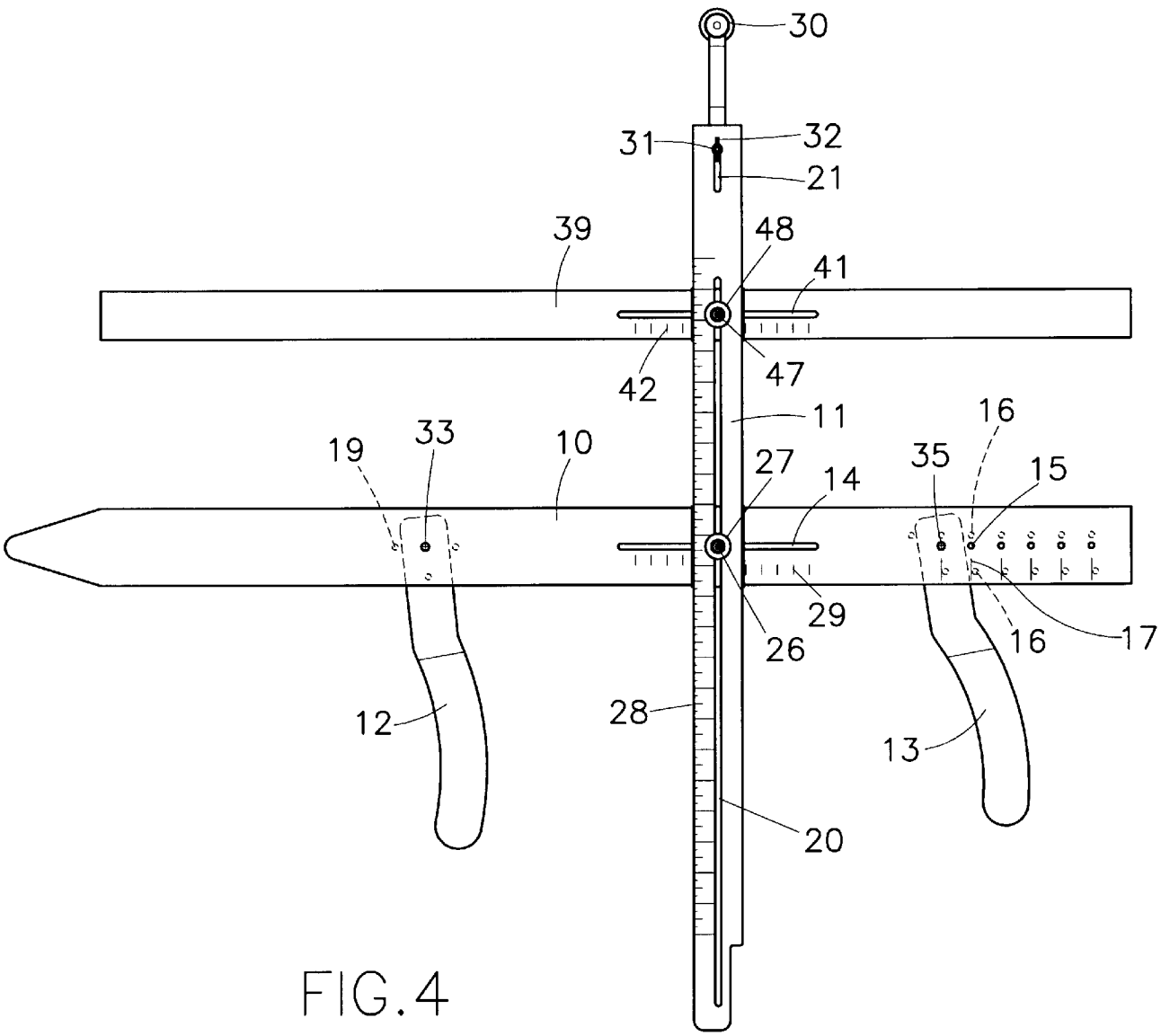
FIG. 4 is the top view of the present invention.

With reference now to FIG. 2 to 8, the swing-practicing device for golf of the invention comprises a first shaft 10, a second shaft 11, a third shaft 12, a fourth shaft 13 and a fifth shaft 39. The first shaft 10 is of flat-plate shape and has a first sliding groove 14 along the lengthwise direction thereof. The first shaft 10 has a scale 29 on top side thereof and beside the sliding groove 14. Moreover, the first shaft 10 has a plurality of first fixing holes 15 on one end thereof and a second fixing hole 18 on another end thereof. A plurality of clamping holes 16 are arranged on the bottom of the first shaft 10 and corresponding to the rim of the first fixing hole 15, and a scale 17 is arranged on top of the first shaft and corresponding to the first fixing hole 15. A plurality of clamping holes 19 are arranged on bottom of the first shaft 10 and corresponding to the rim of the second fixing hole 18.

Figure 5:
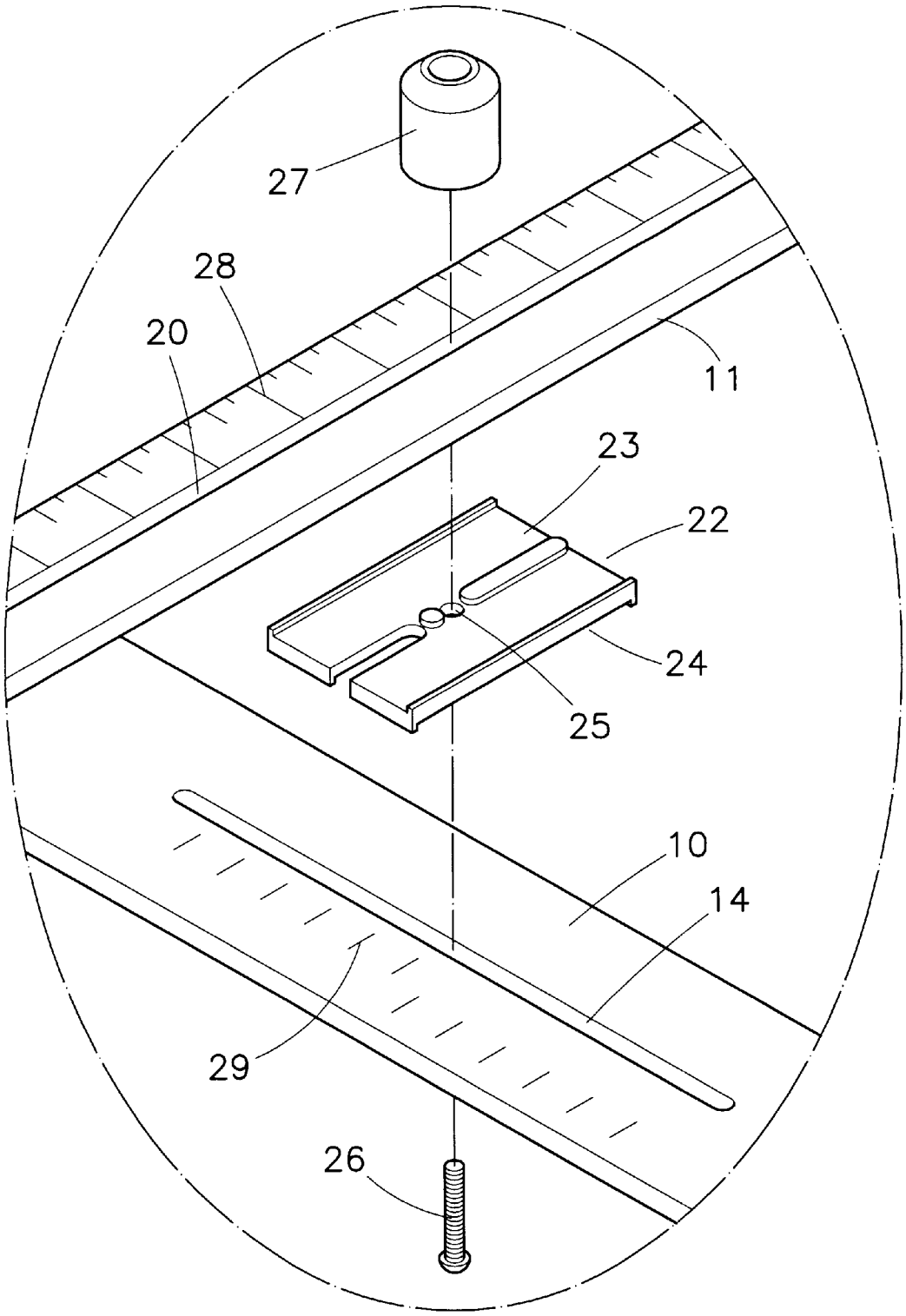
FIG. 5 is a partially perspective view of the present invention.
Figure 8:
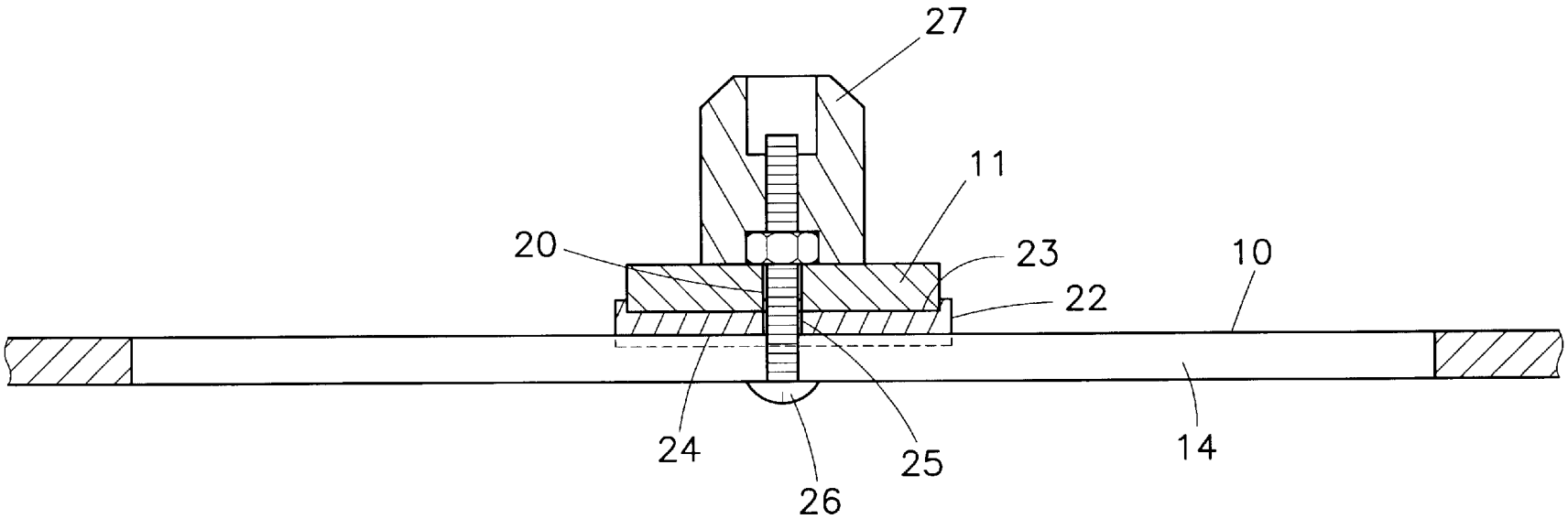
FIG. 8 is the cross section view of the present invention.

The second shaft 11 is a flat plate with a predetermined length and has a second sliding groove 20 and a third sliding groove 21 along the lengthwise direction thereof. A scale 28 is arranged on top of the second shaft 11 and beside the second sliding groove 20. A clamping member 22 is arranged between the second shaft 11 and the first shaft 10, as shown in FIG. 5. The top and bottom of the first clamping member 22 are provided with an upper clamping groove 23 and a lower clamping groove, which are vertically intersected to each other and functioned to clamp the second shaft 11 and the first shaft 10. A through hole 25 is arranged on the first clamping member 22, a bolt 26 pass through the first sliding groove 14 of the first shaft, the through hole 25 of the first clamping member 22, the second sliding groove 20 of the second shaft 11, as shown in FIG. 8, and the screwed with a nut 27. The first shaft 10, the first clamping member 22 and the second shaft 11 can be pivotally connected by the bolt 26 such that the first shaft 10 and the second shaft 11 can be rotated with respect to the bolt 26 to expand or contract the practicing device.

Figure 7:
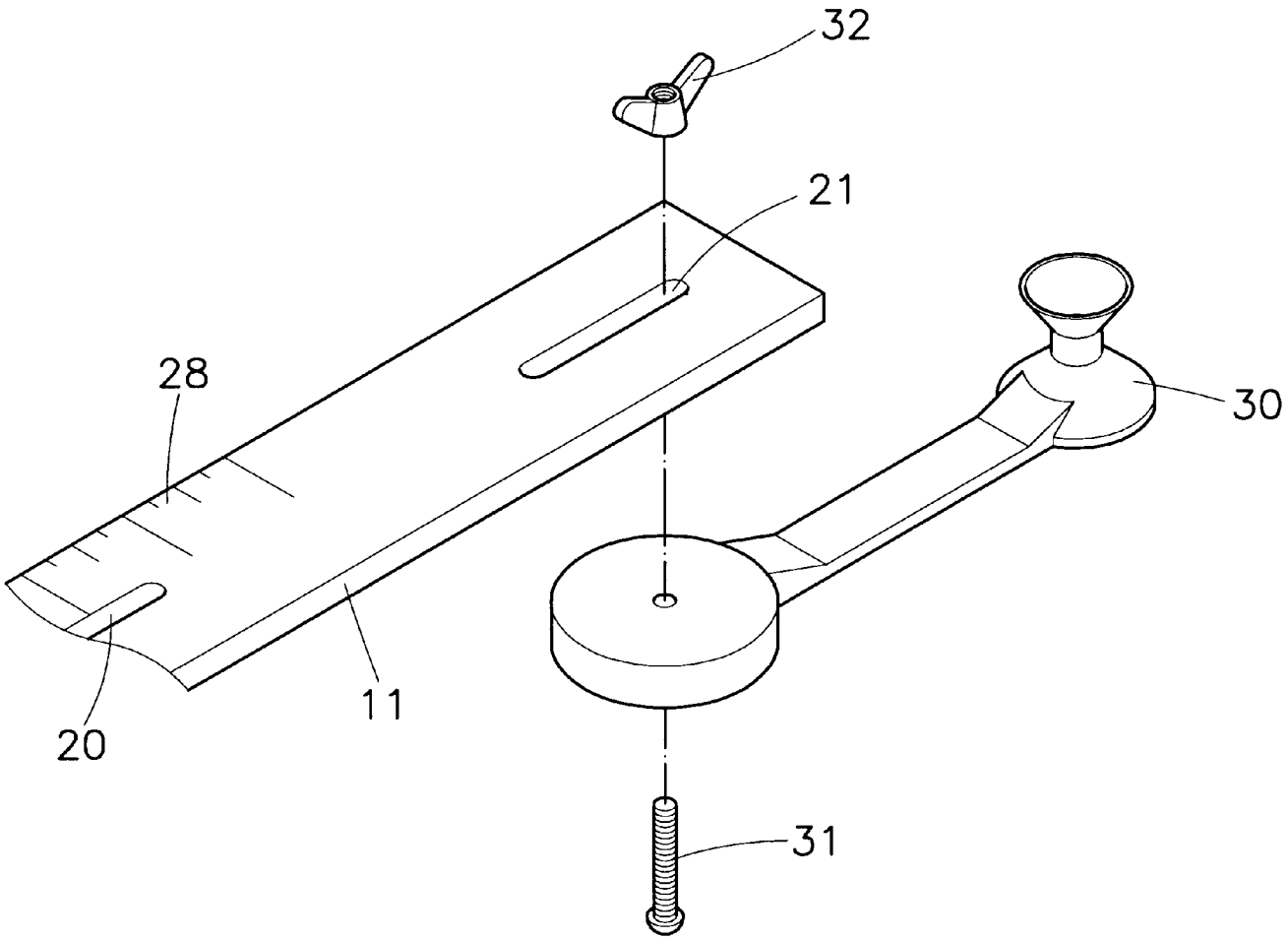
FIG. 7 is another partially perspective view of the present invention.

As shown in FIG. 7, a ball mount 30 is arranged at one end of the second shaft 11. More particularly, a bolt 31 passes through one end of the ball mount 30, the third sliding groove 21 of the second shaft, and finally screwed to a nut 32. By the bolt 31, the ball mount 30 is pivotally arranged at one end of the second shaft 11.

The third shaft 12 is pivotally arranged with the second fixing hole 18 of the first shaft 10, wherein a bolt 33 passes through the second fixing hole 18 of the first shaft 10 and one end of the third shaft 12, and finally screwed to a nut 34. By the bolt 33, the third shaft 12 is pivotally arranged on one side of the first shaft 10 and rotates with respect to the bolt 33 to expand or contract the practicing device. The third shaft 12 has a predetermined curvature and has a clamping body 37 projecting from the top thereof. The clamping body 37 can be received within a clamping hole 19 on bottom of the first shaft 10 such that the third shaft 12 can be clamped when rotating around the bolt 33 for expanding or contracting the practicing device.

Figure 6:
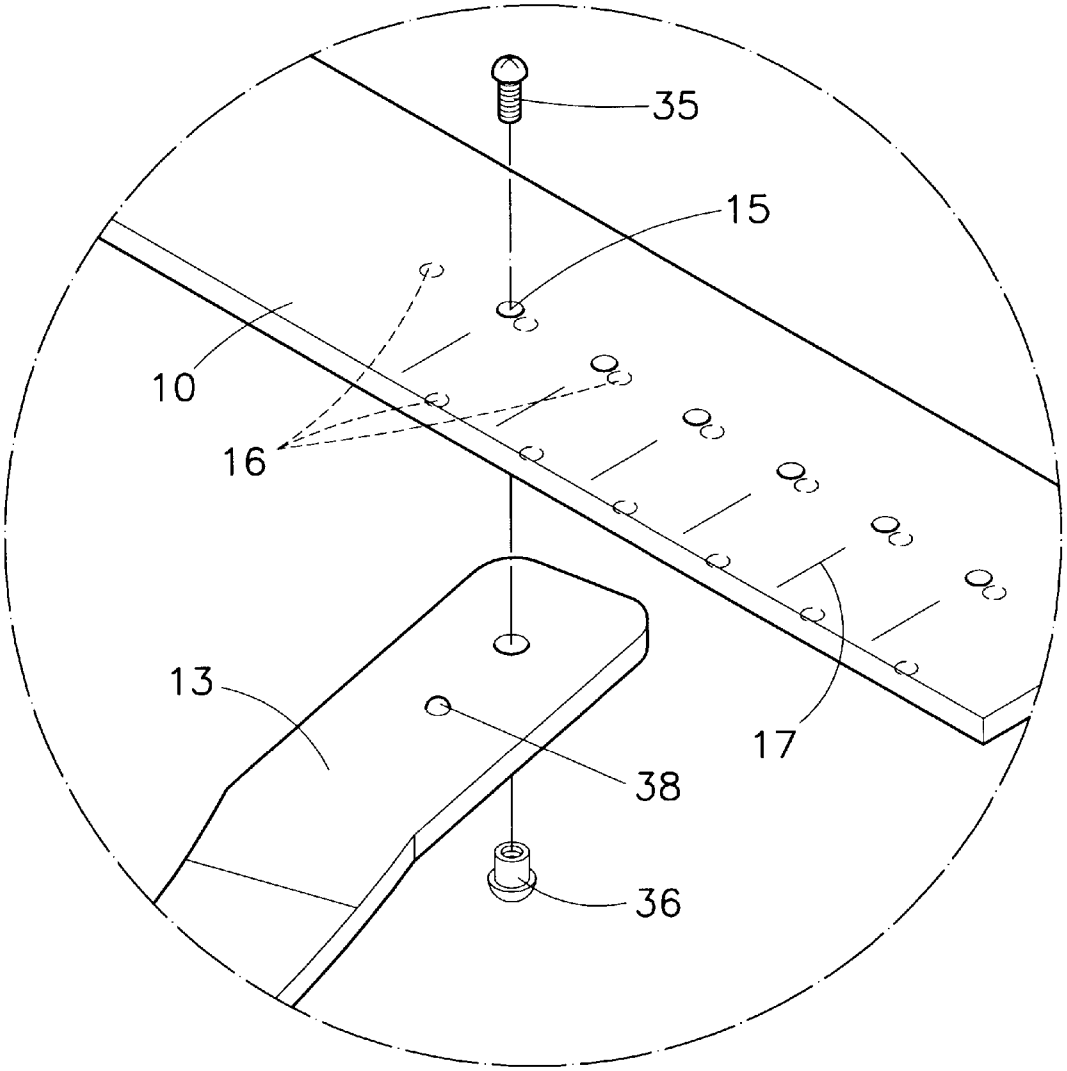
FIG. 6 is another partially perspective view of the present invention.

The fourth shaft 13 is pivotally arranged within the first fixing hole 15 of the first shaft 10, wherein a bolt 35 passes through the first fixing hole 15 of the first shaft 10, and one end of the fourth shaft 13, as shown in FIG. 6, and finally screwed to a hut 36. By the bolt 35, the fourth shaft 13 is pivotally arranged on one side of the first shaft 10, and rotates around the bolt 35. The fourth shaft 13 also has a predetermined curvature and a clamping body 38 projecting from the top surface thereof. The clamping body 38 can be received within a clamping hole 16 on the bottom of the first shaft 10 such that the fourth shaft 13 can be clamped when rotating around the bolt 35 for expanding or contracting the practicing device.

The fifth shaft 39 is a flat plate with a predetermined length and has a fourth sliding groove 41 along the lengthwise direction thereof. A scale 42 is arranged on top of the fifth shaft 39 and beside the fourth sliding groove 41. A second clamping member 43, which is similar to the first clamping member 22, is arranged between the fifth shaft 39 and the second shaft 11. The top and bottom of the second clamping member 43 are provided with an upper clamping groove 44 and a lower clamping groove 45, which are vertically intersected to each other and functioned to clamp the second shaft 11 and the fifth shaft 39. A through hole 46 is arranged on the second clamping member 43, a bolt 47 passes through the fourth sliding groove 41 of the fifth shaft, the through hole 46 of the second clamping member 43, the second sliding groove 20 of the second shaft 11, as shown in FIG. 8, and the screwed with a nut 48. The fifth shaft 39, the second clamping member 43 and the second shaft 11 can be pivotally connected by the bolt 47 such that the fifth shaft 39 and the second shaft 11 can be rotated with respect to the bolt 47 to expand or contract the practicing device.

Figure 9:
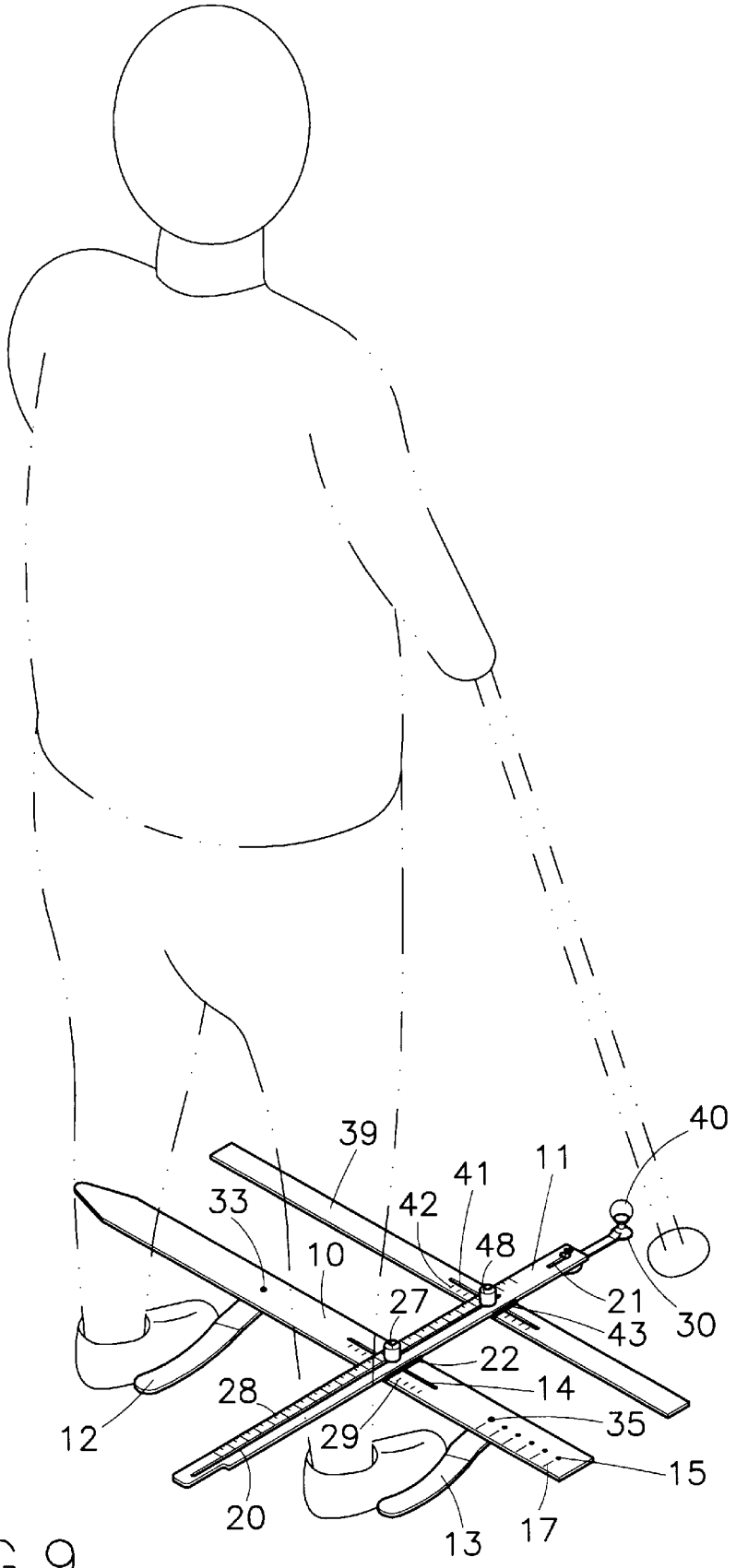
FIG. 9 shows the operation of the present invention.

As shown in FIG. 9, in application, the golf practicing device is preferably arranged on the ground and the ground is divided to multiple regions by the plurality of shafts 10, 11, 12, 13 and 39. Both feet of the user can be precisely placed with reference to the third shaft 12 and the fourth shaft 13. According to various sizes of the user, the bolt 35 and the nut 36 can be selectively connected to various first fixing holes 15, with reference to the scale 17 on top of the first shaft 10. Moreover, the golf ball 40 is placed on the ball mount 30 and the second shaft 11 is adjustably moved along the first sliding groove of the first shaft 10, and more precisely adjusted with reference to the scale 29 on top of the second shaft. Moreover, the second shaft 11 can also be adjustably moved along the second sliding groove 21, whereby the golf ball 40 can be firmly and precisely clamped to a predetermined location for the user to practice swinging. The fifth shaft 39 can be functioned as the guide line of swinging to enable the user has more precise practice.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A swing practicing device for golf, comprising:

(a) a first shaft having a first groove extending longitudinally therein, a plurality of first fixing holes formed in longitudinally spaced relationship adjacent to one end of said first shaft and spaced from one end of said first groove, a second fixing hole formed in said first shaft and spaced from an opposing end of said first groove, and a plurality of clamping holes formed in a bottom of said first shaft in proximity to said first and second fixing holes;

(b) a second shaft having:

a second groove extending longitudinally therein, and a third groove extending longitudinally adjacent a distal end of said second shaft and longitudinally spaced from said second groove;

(c) a third shaft pivotally secured to said first shaft with a pivotal axis passing through said second fixing hole;

(d) a fourth shaft pivotally secured to said first shaft with a pivotal axis passing through a selected one of said first fixing holes, each of said third and fourth shafts including a clamping body extending from a top surface thereof for engagement with a respective one of said clamping holes corresponding to said first and second fixing holes for restricting unwanted rotative motion of said third and fourth shafts about their respective pivotal axes;

(e) a fifth shaft having a fourth groove extending longitudinally therein, said fifth shaft being positioned laterally with respect to said first shaft and said second shaft extending transversely across said first and fifth shafts;

(f) first and second clamping means, said first clamping means securing said first and second shafts through said first and second grooves and for adjusting a relative position of said second shaft relative to said first shaft, said second clamping means securing said fifth and second shafts through said fourth and second grooves and for adjusting a relative position of said second shaft relative to said fifth shaft; and, (g) a ball mount member for supporting a golf ball thereon, said ball mount being secured to said distal end of said second shaft, said ball mount being coupled to said second shaft through said third groove to selectively adjust a position of said ball mount with respect to said second shaft.

2. The swing-practicing device for golf as in claim 1, wherein each of said third and fourth shafts have a predetermined curvature.

* * * * *